United States Patent [19]

Vogel et al.

[11] 3,956,976

[45] May 18, 1976

[54] APPARATUS FOR EXPANDING AND TRANSFERRING A CARTON

[75] Inventors: Walter H. Vogel, Hoffman Estates; Thomas E. Close, Joliet, both of Ill.

[73] Assignee: Crompton & Knowles Corporation, Worcester, Mass.

[22] Filed: Oct. 4, 1974

[21] Appl. No.: 512,763

[52] U.S. Cl. ..... 93/53 SD; 93/53 R; 93/53 M

[51] Int. Cl.[2] ..... B31B 1/76

[58] Field of Search ..... 93/53 SD, 53 R, 53 BF, 93/36 R, 49 R, 53 M; 53/186

[56] References Cited

UNITED STATES PATENTS

| | | | |
|---|---|---|---|
| 2,601,481 | 6/1952 | Williams | 93/53 SD |
| 2,698,559 | 1/1955 | Harkess | 93/53 SD |
| 2,900,880 | 8/1959 | Engleson et al. | 93/53 SD |
| 3,040,635 | 6/1962 | Engleson et al. | 93/53 R |
| 3,633,470 | 1/1972 | Bingham | 93/53 R |
| 3,783,752 | 1/1974 | Langen et al. | 93/53 SD |

*Primary Examiner*—James F. Coan

[57] ABSTRACT

Means for and the method of expanding and transferring a carton from a stack of collapsed cartons in a magazine to a bucket on a conveyor wherein the collapsed cartons are extracted singly from the magazine first by a suction means and transferred to a second suction means which deposits the carton into the conveyor bucket. The cartons comprise at one end thereof two side flaps and a front flap which includes a tuck flap. Stationary cams are utilized to partially expand a carton while it is being transferred and pushing the front flap inwardly while the carton is partially expanded which spreads one of the side flaps outwardly. This side flap is then held while the front flap is released and the other side flap and front flap are spread outwardly from the inside. Finally, all the flaps are maintained in a spread position while the carton is fully expanded.

3 Claims, 7 Drawing Figures

98
90
C1
84
84
52
36
36
18
50
60
34
34
92
59
62
44
68
72
98
16
16
66
42
72
58
18
94
C2
94
98
16
16
18
98
16
16
14

68
58
62
64
72
70
66
72
70
44
72

APPARATUS FOR EXPANDING AND TRANSFERRING A CARTON

BACKGROUND OF THE INVENTION

This invention relates to packaging machines, and more particularly to apparatus for expanding collapsed cartons. Prior art machines utilize a single pivoted suction device which removes the lowermost carton of a stack of collapsed cartons and deposits the carton in the bucket of a conveyor by either stradling the conveyor or passing between a split conveyor. Means are employed between the stack and the conveyor to expand the carton. The speed of this type of machine is limited in that the suction device cannot be brought back to the stack of collapsed cartons until the carton moves out of the way. Attempts to solve this problem include the use of two or more elements to transfer the carton in different stages which greatly complicates the machine. One of the simplest of these mechanisms comprises a pair of spaced transfer wheels provided with cutouts. A pivoted suction device is used to extract the carton from the magazine and to deposit it within the cutouts of the transfer wheels. The carton is then transferred from the wheels to a conveyor bucket. Some variations in carton size can be accommodated by offsetting the cutouts of one wheel to the other, however only a limited size range can be accommodated.

In addition to expanding the carton, the flaps at one end of the carton must be spread outwardly so that they do not interfere with the insertion of a product into the expanded carton. The flaps of the carton typically comprise two equal side flaps and a front flap which includes a tuck flap at the end thereof and which extends beyond the side flaps. Since the front flap extends beyond the side flaps it is relatively easy to employ a stationary cam surface for engaging the front flap and spreading it back as the expanded carton is advanced past the cam surface. However, the side flaps present a problem since they are of equal length. This problem is solved by employing a rotating or reciprocating member which is timed to wipe against one of the side flaps and spread it back as the expanded carton is being transferred from a stack to a conveyor. With one side flap spread back, it is then relatively easy to spread the other side flaps back by conveying the opened carton by a stationary cam surface as long as the carton is orientated so that the remaining side flap to be spread is the trailing flap of the moving carton.

SUMMARY OF THE INVENTION

It is a primary object of the invention to provide a carton expander and transfer mechanism which operates at a high rate of speed and which can accommodate a wide range of carton sizes.

Another object of the invention is eliminate the need of a positively operated side flap spreader by providing a novel method of and means for expanding a carton during transfer and spreading the flaps of at least one end of a carton during transfer to enable a product to be easily inserted in the expanded carton.

The objects of the invention are accomplished by providing two suction devices, a first suction device for extracting a collapsed carton from a stack and carrying it to a first point where it is engaged by the second suction device. The first suction device is deactivated and the carton is then carried to a conveyor bucket at which point the second suction device is deactivated to deposit the carton in the bucket. During this period of time, the first suction device returns to extract another carton from the magazine so that the mechanism can be operated efficiently and at a high rate of speed. The flaps at one end of the carton are spread outwardly and the carton is expanded during the transfer of the carton from the stack in the magazine to the conveyor. The flaps which are to be spread comprise a pair of side flaps and a front flap which includes a tuck flap. When the carton is in the unexpanded state, these flaps lie in the same planes as the side from which they extend. As the collapsed carton is carried from the magazine to the conveyor, the carton is partially expanded and the front flap is pushed in so that it pushes against the inside of one of these side flaps and spreads it outwardly. This side flap is then held and the front flap released after which the remaining side flap and front flap are engaged on their inside surfaces and spread outwardly. Finally, all three flaps are held in spread position while the carton is fully expanded. The spreading of the flaps in this novel manner is accomplished by a plurality of cam surfaces located at strategic points along the path of travel of the carton from the magazine to the conveyor.

DETAILED DESCRIPTION OF THE INVENTION

Figure 1:
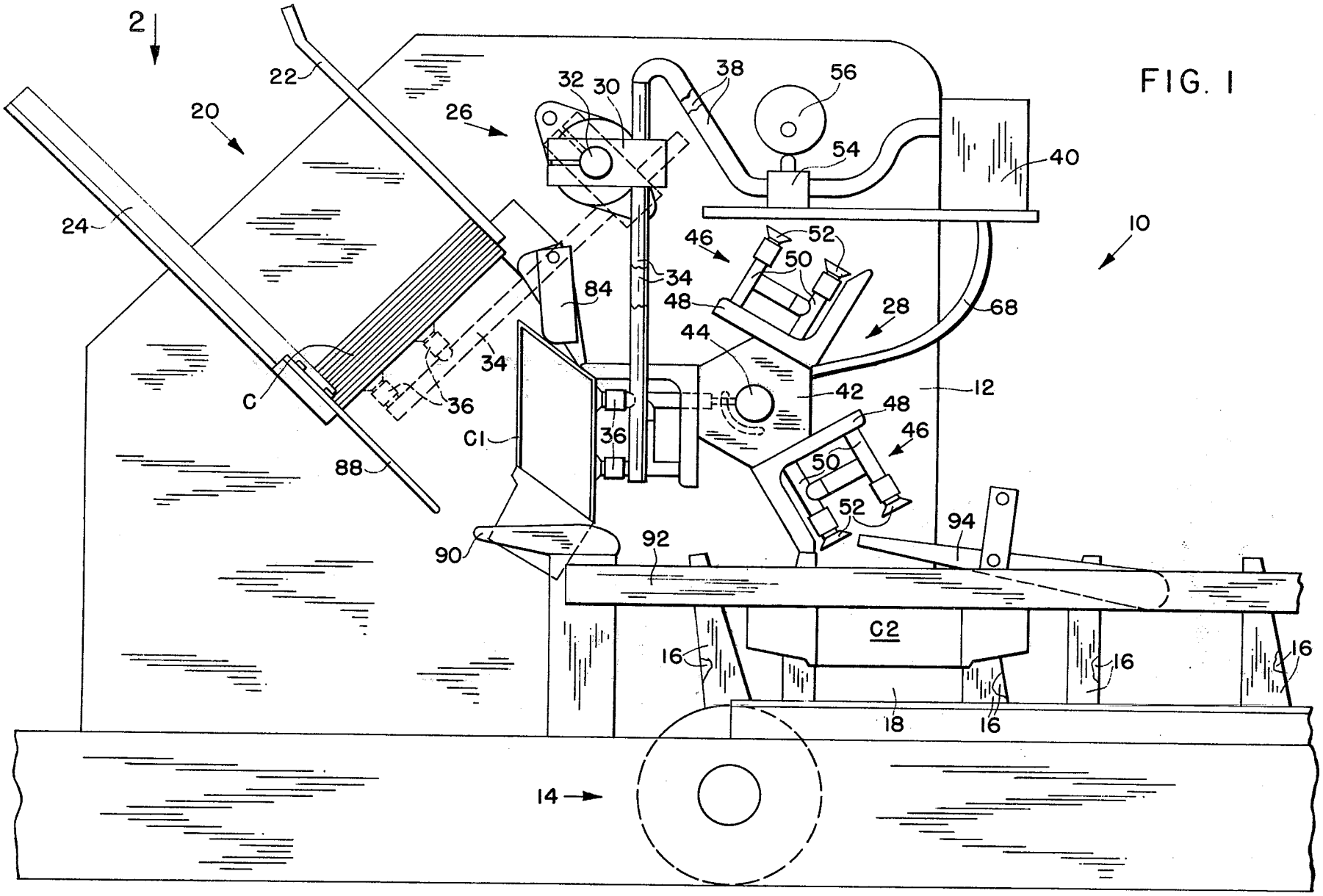
FIG. 1 is a view in side elevation showing apparatus for transferring and expanding collapsed cartons and embodying the principles of the present invention.
Figure 2:
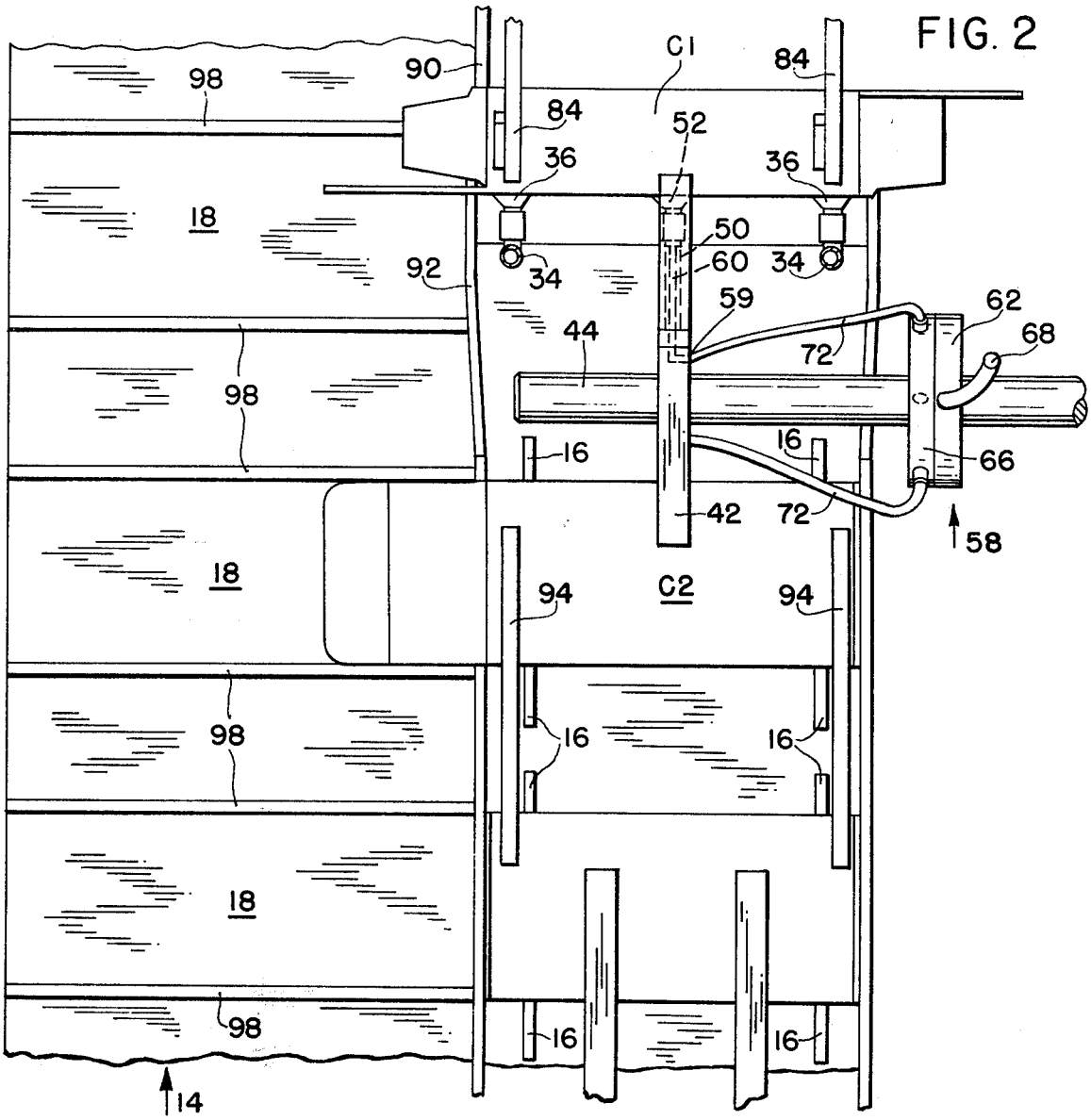
FIG. 2 is a plan view thereof.

Referring particularly to FIGS. 1 and 2 the packaging machine to which the invention is applied is generally indicated by the reference numeral 10 and includes framework indicated at 12. A conveyor generally indicated by the reference numeral 14, extends longitudinally of the machine and is provided with a plurality of spaced pairs of lugs 16 which form pockets or buckets 18 therebetween. Buckets 18 are adapted to receive expanded cartons and carry them along the machine to be subsequently filled with product by mechanism not shown but well known in the art.

The magazine for supporting the collapsed cartons is identified by the reference numeral 20 and is mounted on the framework 12. Magazine 20 comprises an upper wall 22 and lower 24 wall which are adjustable towards each other for accommodating different sizes of cartons. The collapsed cartons indicated by the reference numeral C are arranged in a stack within the magazine. The mechanism for extracting cartons from the magazine and transferring them to the conveyor 14 comprises a first suction means generally indicated at 26 and a second suction means generally indicated by the reference numeral 28.

Suction means 26 includes a block 30 fixed to a pivoted shaft 32 and a pair of hollow arms 34 adjustably mounted in block 30. A pair of suction cups 36 are mounted near the end of each arm 34 and are pneumatically connected to the hollow interior of the arm.

Tubes 38 connect the opposite ends of arms 34 to a source of air at sub-atmospheric pressure indicated at 40 to create suction in cups 36. Arms 34 are reciprocated by drive mechanism within the enclosed framework 12 between a carton extruding position as shown in dotted lines in FIG. 1 to and slightly beyond a first point or position shown in full lines in FIG. 1. As arms 34 move away from the dotted line position, the lowermost carton is extracted from the stack within magazine 20. Escapement mechanism, not shown but well known in the art, allows the cartons to be extracted one at a time.

Suction means 28 includes a block 42 fixed to a shaft 44 and three suction units 46 mounted at equadistant points on the block 42. Each unit 46 includes a bracket 48 which supports a pair of tubes 50. There is a suction cup 52 mounted on the ends of each tube 50. Shaft 44 is rotated by drive mechanism within enclosed framework 12 in synchronism with the first suction means 26 so that shaft 44 makes one revolution for each three reciprocations of arms 34. The timing is such that the suction cups 52 of one of the units 46 will engage a carton being transported by suction cups 36 when arms 34 reach the first position indicated by full lines in FIG. 1. The suction to cups 34 is cut off by a valve 54 located intermediate lines 38 and source 40. A cam 56 driven in timed relation with the second suction means 28 closes valve 54 to deactivate first suction means 26 when it is in the full line position as shown in FIG. 1. The carton is thereby released from first suction means 26 just after it is engaged and held by the suction cups 52 of second suction means 28. Arms 34 have a small amount of overtravel after suction is cut off to the cups 36 to allow the carton to be swung down by one of the units 46 of second suction means 28 from the first point or position represented by partially expanded carton C1 to a second point or position within one of the conveyor buckets 18 just ahead of the position shown by fully expanded carton C2.

Figure 3:
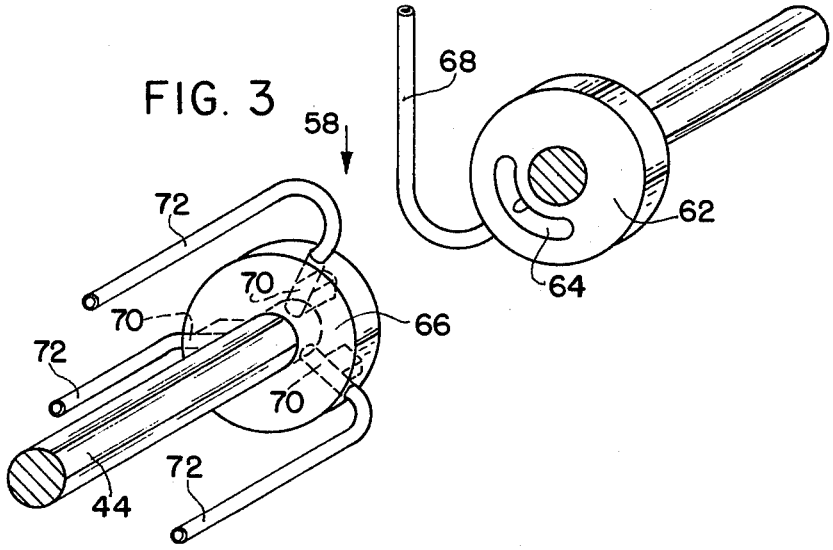
FIG. 3 is fragmentary exploded view of a valve for controlling the vacuum to the second suction device.

Valve means generally indicated by the reference numeral 58 in FIG. 3 operates in timed relation with first suction means 28 to activate each unit 46 when it reaches the position of engagement with a carton at the first point indicated by carton C1 and to deactivate the unit after it has placed the carton within a bucket 18.

Block 42 has a port 59 for each unit 46. The tubes 50 of each unit 46 are connected to their respective ports by channels 60 within the block, see FIG. 2. Valve 58 comprises a first stationary disc 62 which contains a radial slot 64 and a second disc 66 which is fixed to shaft 44 for rotation therewith. Slot 64 is pneumatically connected to sub-atmospheric pressure source 40 by an air line 68 so that a vacuum condition is always present in slot 64. Disc 66 has three slots 70 which extend along the face of disc 66 which abuts disc 62. Slots 70 are disposed at equadistant points along the face of disc 66 and pneumatically communicate with slot 64 during periods of alignment therewith as disc 66 rotates relative to disc 62. Air lines 72 connect slots 70 to corresponding ports 59 in block 42 so that as each unit 46 moves from the first position to the second position above the conveyor, its corresponding slot 70 will be alligned with slot 64 and the unit will be activated. The unit will be deactivated during the remainder of its travel as its corresponding slot 70 will be alligned with slot 64. Each unit 46 will be activated in turn as it travels between the first and second positions. Additional blocks 42 with units 46 could be employed for large packages if desired. The air lines 72 could be split to accommodate additional units. By the same token some of the suction cups 52 or 36 could be removed and the openings sealed to accommodate smaller packages.

The means for expanding the cartons and spreading the flaps thereof as the cartons are transferred, comprise several stationary cams. The collapsed cartons in the magazine have flaps which must be spread at at least one end thereof to enable product to be easily inserted within the expanded carton; see FIGS. 4–7. These flaps comprise a first side flap 74, a second side flap 76 and a front flap 78 with a tuck portion 80 which lie in the same planes as the sides of the cartons from which they extend. The first side flap and front flap lie in the same plane when the carton is in the collapsed state in the magazine.

Figure 4:
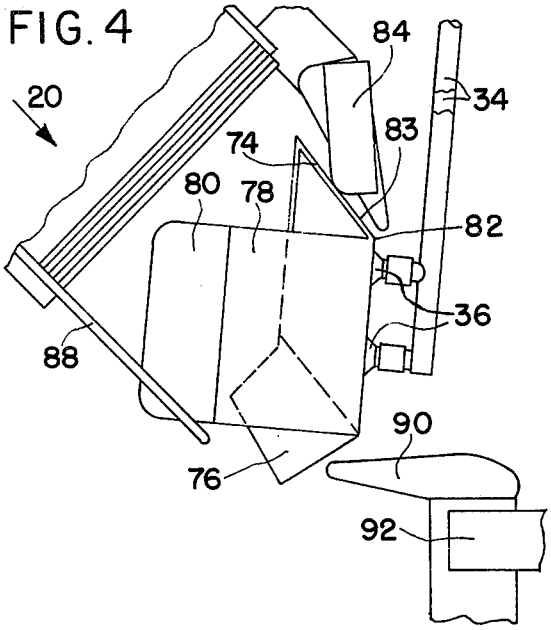
FIGS. 4, 5, 6 and 7 are fragmentary views illustrating the sequence of steps for expanding a carton and spreading the flaps thereof as the carton is transferred from a magazine stack to a bucket conveyor.
Figure 5:
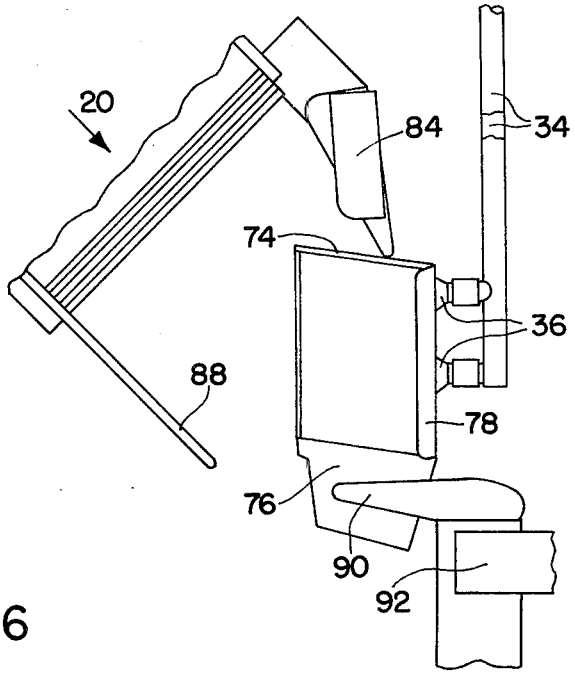
Figure 5:
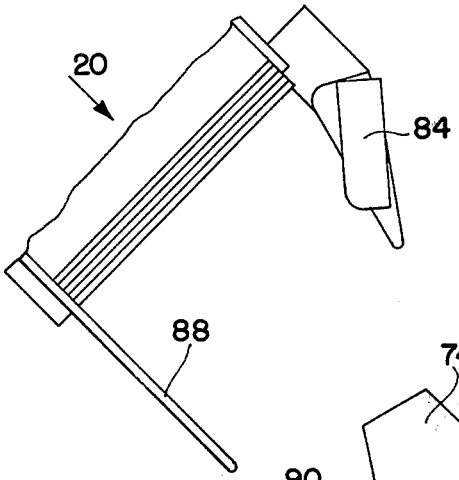
Figure 6:
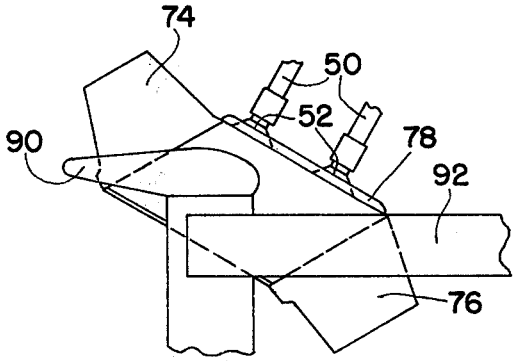

The steps of expanding a carton and spreading the flaps are shown diagramatically in FIGS. 4, 5, 6 and 7. After arms 34 have extracted a collapsed carton from the stack in the magazine, the upper leading edge 82 and the surface 83 of the carton strike the lower surface of a first stationary cam 84 which causes the carton to expand as shown in FIG. 4. While the carton is partially expanded, the front flap 78 strikes the inside surface of a second stationary cam 88. This forces front flap 78 inwardly toward the carton and since the carton is only partially expanded, second side flap 76 is engaged by the front flap and spread outwardly as shown in FIG. 4. As the carton continues to be moved downwardly, flap 76 which now extends below the carton strikes the inside surface of a third cam 90. Flap 76 is held in the spread position by cam 90 as the carton continues to move down so that front flap 78 springs free of cam 88 as shown in FIG. 5. At this point, the carton is transferred from first suction means 26 to second suction means 28. The carton is thereby carried downwardly and partially rotated around its longitudinal axis as it swings along an arc from the center of shaft 44. This motion brings the first side flap 74 into contact with cam 90 and is spread outwardly as the carton continues to be carried down as shown in FIG. 6.

Figure 7:
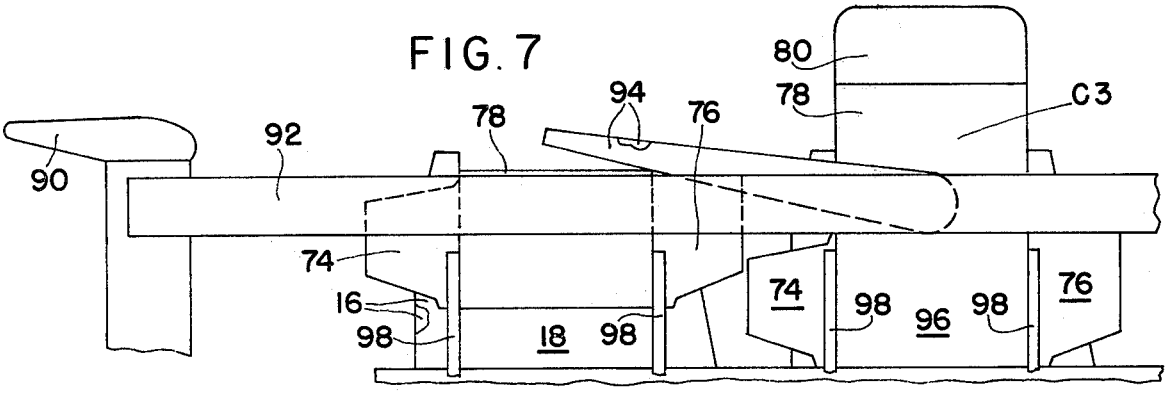

Front flap 78 rides over cam 90 and continues to ride over an extension 92 of cam 90 after the carton is brought to the second position into a bucket 18. The suction to the unit 46 carrying the carton is cut off at the second point and the carton is then transported horizontally by the trailing lug 16 which forms part of the bucket 18 into which the carton is deposited. Extension 92 continues to maintain side flaps 74 and 76 in the spread position. The carton is nearly expanded as the lugs assume a vertical position as shown in FIG. 7. Full expansion to the point where the carton is completely squared or expanded occurs when the carton engages the lower surfaces of a pair of fourth cams 94 and is pushed down to the conveyor so that the opening 96 of the opened carton is below extension 92 to receive a product as shown in FIG. 7. Walls 98 of a product conveyor which travels in synchronism with conveyor 14 are alligned with the carton as it travels horizontally within a bucket 18. The inside surface of extension 92 maintains the side flaps 74 and 76 in the spread position as the carton is fully expanded. When the carton reaches its final lower position as indicated by carton C3 in FIG. 7 the inside edge of walls 98 maintain side flaps 74 and 76 in the spread position. Front flap 78 is spread outwardly by the inside surface of extension 92 as the carton is forced down by cams 94 as illustrated by carton C3 in FIG. 7. At this point all of the flaps are spread, the carton is fully expanded and is ready for the insertion of a product.

We claim:

1. In a packaging machine having a conveyor with spaced buckets for carrying expanded cartons and a magazine for holding a stack of collapsed cartons, said magazine having an opening therein for extracting said cartons from said machine, each of said cartons having flaps which lie in the same plane as the sides of the carton from which they extend and which comprise a first side flap, a second side flap, and a front flap including a tuck flap, said front flap extending beyond said side flaps and lying in the same plane as said first side flap, carton expanding and flap spreading means comprising:

a. first suction means for engaging and extracting from said stack a single carton through the opening in said magazine and carrying said carton along a first path to a first point;

b. second suction means synchronized with said first suction means and said conveyor for engaging said carton at said first point and carrying said carton along a second path to a second point within a bucket on said conveyor;

c. control means for deactivating the suction of said first suction means upon engagement of said carton by said second suction means and for deactivating said second suction means when said carton reaches said second point;

d. a first stationary cam surface for engaging the longitudinal edge and side of a collapsed carton from which said first side flap extends as said carton is carried along said first path for partially expanding said carton;

e. a second stationary cam surface for engaging and partially closing the front flap of said partially expanded carton as said carton is carried along said first path so that it spreads said second flap outwardly, said second cam surface being effective to disengage from said front flap as said carton is carried along said second path;

f. a third stationary cam surface for engaging the inside of said second side flap before said front flat is disengaged from said second stationary cam and being effective after said front flap is disengaged from said second stationary cam to engage the inside surfaces of said first and front flaps and spread them outwardly as said carton is carried along said second path and by said conveyor; and g. a fourth stationary cam surface for cooperating with said conveyor buckets and being effective to fully expand said carton within a conveyor bucket.

2. In a packaging machine as set forth in claim 1 wherein said second suction means comprises at least one finger for engaging the side of said carton from which said first flap extends to maintain said carton partially expanded.

3. In a packaging machine having a conveyor with spaced buckets for carrying expanded cartons and a magazine for holding a stack of collapsed cartons, said magazine having an opening therein for extracting said cartons from said magazine, each of said collapsed cartons having flaps at at least one end thereof which lie in the same plane as the sides of the carton from which they extend and which comprise a first side flap, a second side flap, and a front flap including a tuck flap, said front flap extending beyond said side flaps and lying in the same plane as said first side flap, the invention comprising means for transferring and expanding collapsed cartons from a magazine to a carton conveyor and spreading the flaps thereof, said means comprising:

a. means for engaging and extracting from said stack a single carton through the opening in said magazine and carrying said carton along a path to a conveyor bucket;

b. a first stationary cam surface for engaging the longitudinal edge and side of a collapsed carton from which said first side flap extends as said carton is carried along said path for partially expanding said carton;

c. a second stationary cam surface for engaging and partially closing the front flap of said partially expanded carton as said carton is carried along said path so that it spreads said second side flap outwardly, said second cam surface being effective to disengage from said front flap as said carton is carried along said path;

d. a third stationary cam surface for engaging the inside of said second side flap before said front flap is disengaged from said second stationary cam to engage the inside surfaces of said first and front flaps and spread them outwardly as said carton is carried along said path and by said conveyor bucket; and e. a fourth stationary cam surface for cooperating with said conveyor buckets and being effective to fully expand said carton within a conveyor bucket.

* * * * *